US007438810B2

(12) United States Patent
Lindl et al.

(10) Patent No.: US 7,438,810 B2
(45) Date of Patent: Oct. 21, 2008

(54) SIEVE DEVICE

(75) Inventors: Markus Lindl, Dietfurt (DE); Walter Blomenhofer, Berching (DE)

(73) Assignee: Hans Huber AG Maschinen-und Anlagenbau, Berching (DE)

( * ) Notice: Subject to any disclaimer, the term of this patent is extended or adjusted under 35 U.S.C. 154(b) by 134 days.

(21) Appl. No.: 11/478,568

(22) Filed: Jun. 29, 2006

(65) Prior Publication Data

US 2007/0017880 A1 Jan. 25, 2007

(30) Foreign Application Priority Data

Jul. 1, 2005 (DE) ..... 10 2005 031 221

(51) Int. Cl.

| | |
|---|---|
| ***B01D 29/35*** | (2006.01) |
| ***B01D 29/64*** | (2006.01) |
| ***B01D 29/90*** | (2006.01) |
| ***B01D 35/027*** | (2006.01) |
| ***B30B 9/14*** | (2006.01) |
| ***E03F 5/14*** | (2006.01) |
| ***E02B 5/08*** | (2006.01) |

(52) U.S. Cl. ..... 210/232; 210/236; 210/237; 210/249; 210/415; 210/170.08; 100/117

(58) Field of Classification Search ..... 210/232, 210/415, 170.08, 236, 237, 249; 100/117
See application file for complete search history.

(56) References Cited

U.S. PATENT DOCUMENTS

| | | | | |
|---|---|---|---|---|
| 3,688,687 | A * | 9/1972 | Craig et al. | 100/117 |
| 3,897,215 | A * | 7/1975 | Davidson et al. | 422/255 |
| 4,464,257 | A * | 8/1984 | Lynch et al. | 210/195.1 |
| 5,034,128 | A * | 7/1991 | Hillstrom et al. | 210/411 |
| 6,103,110 | A | 8/2000 | Frommann et al. | |
| 6,187,180 | B1 | 2/2001 | Bruke | |

FOREIGN PATENT DOCUMENTS

DE 4412679 * 4/1994

OTHER PUBLICATIONS

German Patent Office Search Report, Mar. 24, 2006.
Great Britain Search Report, Sep. 15, 2006.

* cited by examiner

*Primary Examiner*—Thomas M Lithgow
(74) *Attorney, Agent, or Firm*—Dority & Manning, P.A.

(57) ABSTRACT

A sieve device for insertion in a shaft has a connection for wastewater arriving in a supply device, which supply device is connected to a sieve surface of the sieve device for separating material to be separated from the wastewater. A worm conveyor transports the material to be separated out of the shaft. A fastening device is arranged in the shaft for the vertical fastening of the sieve device. The fastening device comprises a guide for the sieve device. An intersection is provided between the supply device and the sieve device. The guide positions the sieve device in front of the intersection when the sieve device is moved relative to the supply device into the shaft for purposes of mounting.

11 Claims, 3 Drawing Sheets

SIEVE DEVICE

FIELD OF THE INVENTION

The present invention relates to a sieve device for insertion in a shaft with a connection for wastewater arriving in a supply device, which supply device is connected to a sieve surface of the sieve device for separating material to be separated from the wastewater. A worm conveyor device transports the material to be separated out of the shaft. A fastening device fastens the sieve device upright in the shaft.

BACKGROUND

EP 0 908 569 B1 teaches a generic sieve device inserted in a shaft. The wastewater is supplied to the sieve device via a supply device consisting of a supply pipe and a loading container. The wastewater is freed from the material to be separated in the sieve device in that the water passes through the openings of a sieve surface of the sieve device and the material to be separated is transported with a worm conveyor out of the shaft into a container. In order to separate the wastewater from the material to be separated, the worm conveyor brushes along the wall of the sieve surface of the sieve device.

The edges of the worm conveyor are frequently provided with brushes in order to obtain a close contact with the sieve surface. These brushes must be cleaned regularly in order to obtain the desired separation between water and material to be separated. For this, it is necessary in the state of the art that maintenance personnel climb into the shaft, remove the sieve surfaces and clean the worm conveyor, in particular its brushes. To this end, the water is pumped out of the shaft in advance and the maintenance personnel is subsequently lowered into the shaft. This maintenance work is very unpleasant, in particular in the case of very large sieve devices that can have a length of up to 12 m. It is even forbidden in some countries for maintenance personnel to climb down into the shaft since there can be a significant danger of poisoning on account of the gases in the shaft.

SUMMARY

The present invention therefore addresses the problem of creating a sieve device that is to be cleaned without maintenance personnel climbing down into the shaft in which the sieve device is located. Additional objects and advantages of the invention will be set forth in part in the following description, or may be obvious from the description, or may be learned through practice of the invention.

In a sieve device in accordance with the invention, the fastening device in the shaft is provided with a guide for the sieve device. An interface is provided between the supply device and the sieve device, which guide positions the sieve device in front of the intersection when the sieve device is moved relative to the supply device. Thus, the sieve device can be completely removed from the shaft for maintenance work and is subsequently placed back into the shaft in the exact position. The guide ensures that the sieve device is aligned relative to the supply device and that no more work is required for setting up the two structural components in the shaft. Therefore, mounting workers do not have to climb down into the shaft in order to be able to connect the sieve device to the supply device. The interface is fixed by the fastening device.

An especially advantageous sieve device is connected to the supply device by a loose connection device. This loose connection device makes it possible that the sieve device is connected in its operating position to the supply device in such a manner that the wastewater passes through the supply device into the sieve device. The connection device connects the sieve device to the supply device in a largely tight manner without a complete seal being necessary. Wastewater seeping out of the system at this connection device is not harmful to the water collected in the shaft on account of the slight amount and slight contamination. Rather coarse impurities are removed via the connection device, pass into the sieve device, and are then transported out of the shaft by the worm conveyor.

The particularity of the connection device resides in particular in the fact that during a removal of the sieve device out of the shaft, a separation of sieve device and supply device is made possible without loosening a screw connection. As a result, it is no longer necessary for maintenance personnel to climb into the shaft and perform maintenance work in it or to loosen the connection between the sieve device and the supply device. The sieve device can be removed from the shaft without mounting work in the shaft.

The loose connection device in a particular embodiment consists, e.g., of two pipe ends that empty against one another in an abutting manner or by means of a flange. Moreover, a guide can be provided that surrounds, e.g., a pipe end and guides the other pipe end for an aligned connection of the two pipes into a position concentric to each other when the sieve device is mounted again. Furthermore, a loose connection is also possible in that the supply device empties axially into the sieve device and that the supply device consists of a pipe inserted in an opening of the sieve device and withdrawn from this opening during a removal of the sieve device from the shaft. Alternatively, two flanges can lie flatly against one another even in the axial emptying of the supply device into the sieve device. In any case, it is essential to avoid having operating personnel to have to carry out a mounting activity, e.g., the loosening of a joint connection, in the shaft.

It is especially advantageous if the supply device is a supply pipe. A loose connection device can be installed e.g., in the above-described manner on the supply tube in a very simple manner.

If the supply device is a loading container, the separation between the sieve device and the supply device can also take place in or on the loading container. The loose connection device can be placed in this instance, e.g., between the loading container and the sieve device. Of course, the connection device is also possible in the area of the supply pipe if a loading container is additionally arranged between the supply pipe and the sieve device. It is essential that a loosening of the sieve device from a permanently installed supply device takes place without mounting work inside the shaft being necessary and that the sieve device can thus be removed from the shaft in order to be able to perform maintenance outside of the shaft on the worm conveyor and, optionally, on other components of the sieve device. This makes the dismounting and, after the cleaning, the mounting of the sieve device inside the shaft possible in a very quick and simple manner without danger to the operating personnel.

It is especially advantageous if the loose connection device is a flange of a supply pipe of the supply device. The flange creates no permanent connection of two ends of the supply pipe but rather only brings about a certain seal of two pipes ending close to one another. This does not create a mounting or demounting of the two pipe ends possible only on the flanges. At least a loosening of the connection device by a relative movement of the sieve device relating to the supply device is made possible in this manner.

In order to create a substantial seal of the supply device, it is advantageous if the flange comprises an oblique area open to the top on the side of the supply pipe. This makes it possible to remove the sieve device upwards from the supply pipe. Thus, during the mounting of the sieve device, the upward oblique area rests on the lower oblique area of the supply pipe and substantially seals the supply device.

If the sieve device and the supply device are positioned relative to one another in the area of the loose connection device by means of the fastening device of the sieve device, this creates a constructively simple and economic positioning of the sieve device and of the supply device. The fastening device by which the sieve device is held in the shaft comprises structural components to this end that bring the sieve device into a position in which it is associated in a provided manner with the supply device. As a result, thereof the substantial seal between the supply and the sieve device can take place.

It is especially advantageous for positioning the sieve device in front of the supply device if the fastening device comprises a guide that is axial relative to the sieve device. As a result thereof, the sieve device is separated from the supply device and brought back together along the axial guide when the sieve device is removed from the shaft and moved back into the shaft.

It is especially advantageous if the fastening device comprises a torsional safety for receiving torques, in particular during the starting and the braking of the worm conveyor device. To this end, the fastening device is designed to be so stable that the sieve device is held in its position solely by the fastening device. As a result, a transfer of force from the loose connection device is no longer necessary.

If the fastening device comprises an axial stop associated with it for the sieve device, it can be placed on the axial stop during the mounting of the sieve device. As a consequence, the stop positions the sieve device relative to the supply device in such a manner that a substantial sealing of the connection device takes place.

In an embodiment of the invention that is especially advantageous because it is very simple, the guide of the fastening device is designed as a slide guide. It serves to guide the sieve device during the removal and reinsertion of the sieve device into the shaft. The slide guide can guide the sieve device during the entire movement phase; however, it can also be designed in such a manner that that it does not bring about the exact positioning of the sieve device in front of the supply device until shortly before the end position. It can be designed, e.g., in the form of two door hinges that exactly position the sieve device only in the decisive phase. The slide guide is designed in a continuous manner for an even simpler supplying of the sieve device. This means that the sieve device is introduced into the slide guide while it is still substantially outside of the shaft and is thrust along the slide guide until into its end position.

If the connection device is sealed with a slide seal, a sealing of the connection device is achieved in a very simple manner. In order to separate the connection device, the connection pieces are moved radially away from each other without the screw connection having to be loosened.

In order to be able to perform the mounting work without more water flowing into the sieve device, it is advantageous if a closure device is associated with the supply device. In order to also make no mounting work necessary inside the shaft in this instance, is particularly advantageous if the closure device is a slide that can be operated from outside the shaft and that closes the supply device.

Further advantages of the invention are described in the following exemplary embodiments.

DESCRIPTION

Figure 1:
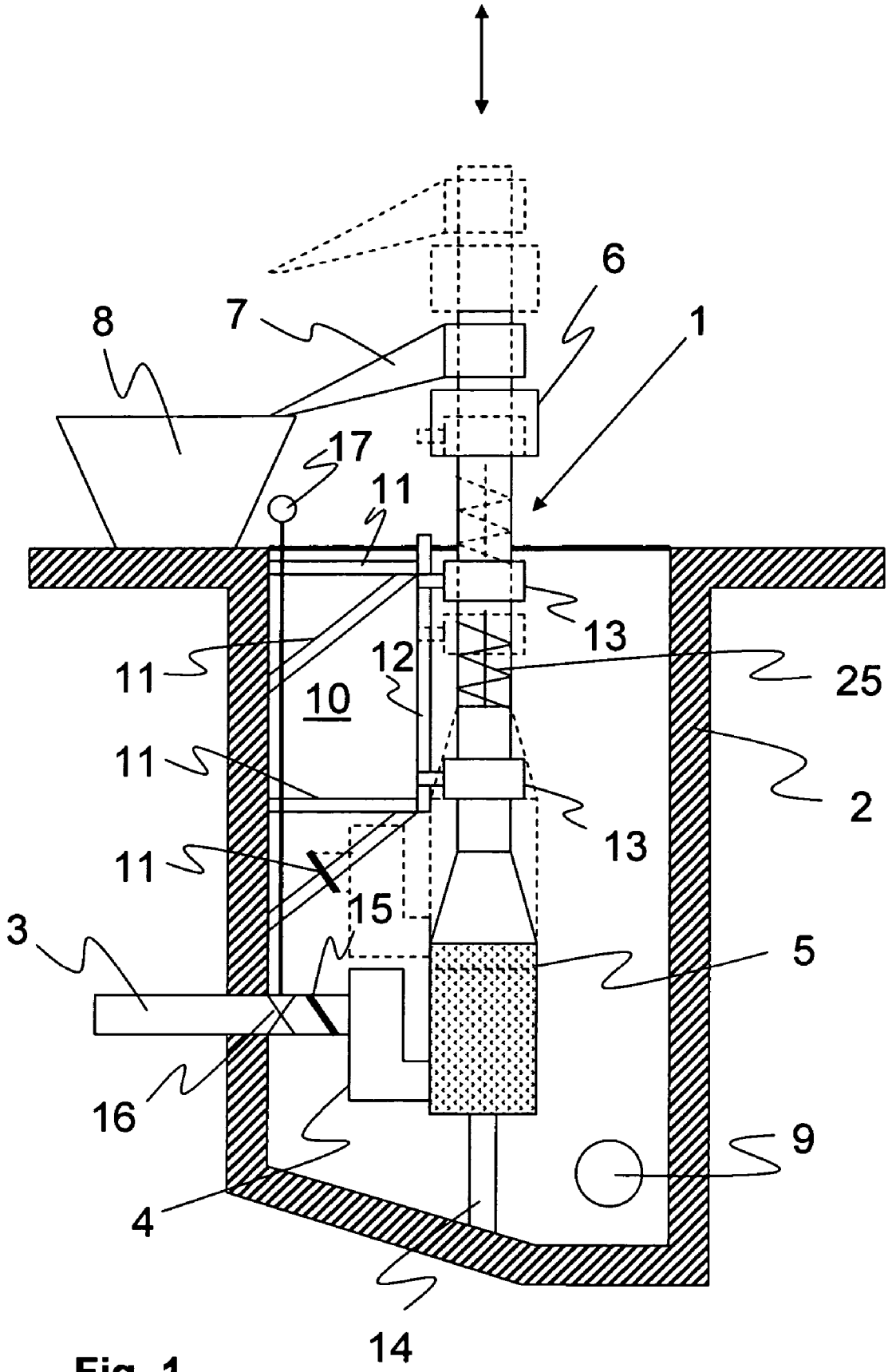
FIG. 1 shows a schematic view of a sieve device in a shaft.

Reference will now be made to embodiments of the invention, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the invention include these and other modifications and variations of the embodiments described herein.

FIG. 1 schematically shows a sieve device 1 arranged in a schematically shown shaft 2. Wastewater flows via supply pipe 3 and loading container 4 into the lower area of sieve device 1 standing vertically in shaft 2. A worm conveyor (only indicated) of worm conveyor device 25 is arranged inside sieve device 1 and transports upward the wastewater and rather coarse particles transported with the wastewater. The lower part of sieve device 1 consists of sieve body 5 in which the wastewater is separated from the material to be separated. The material to be separated is transported by the worm conveyor into the upper area of sieve device 1, where it is compressed in pressing zone 6 and transported via discharge chute 7 into container 8 outside of shaft 2. The water exiting from the sieve surface of sieve body 5 is collected in shaft 2 and flows over runoff 9 either independently or by means of a pump (not shown) out of shaft 2.

Sieve device 1 is fastened to fastening device 10 in shaft 2. Fastening device 10 has transmission 11 and guide 12 that is held on transmission 11. Sieve device 1 is equipped with two holders 13 that cooperate with guide 12. Sieve device 1 can be removed from and introduced back into shaft 2 along guide 12. The removal is required, e.g., in order to clean the worm conveyor, that comprises brushes for a better seal relative to sieve body 5. Axial stop 14 is provided for the axial fixing of sieve device 1, on which stop sieve device 1 rests. Axial stop 14 can of course also be provided in guide 12 in a connection with holders 13. Fastening device 10 is to be designed in a more stable manner in this instance.

In order to be able to remove sieve device 1, as is indicated in dotted lines and with a double arrow, from shaft 2 and to move it back for mounting without the service personnel having to climb into shaft 2, a loose connection of sieve device 1 with supply pipe 3 is provided. The connection takes place in the form of an oblique section through supply pipe 3. The end of supply pipe 3 remaining in shaft 2 has an upwardly open oblique area. It is possible, as a result of this oblique section, to raise sieve device 1 from supply pipe 3 and to place it back on the latter without any screw connections having to be loosened.

Connection device 15 does not have to be designed to be completely tight. After wastewater that exited from sieve body 5 is present in shaft 2, water can also exit from connection device 15. However, rather coarse impurities flow further through the remainder of supply pipe 3 and into loading container 4 and subsequently into sieve device 1. If a better seal of connection device 15 is to take place, a sliding seal can be inserted at the intersection that results in an even better seal against the solid materials during the setting of the sieve device 1 on the oblique section of the supply device In order to prevent wastewater from running into shaft 2 through supply pipe 3 during repair work on sieve device 1, closure device 16 is provided. This closure device 16 can also be closed and opened from outside of shaft 2 by activation device 17.

Figure 2:
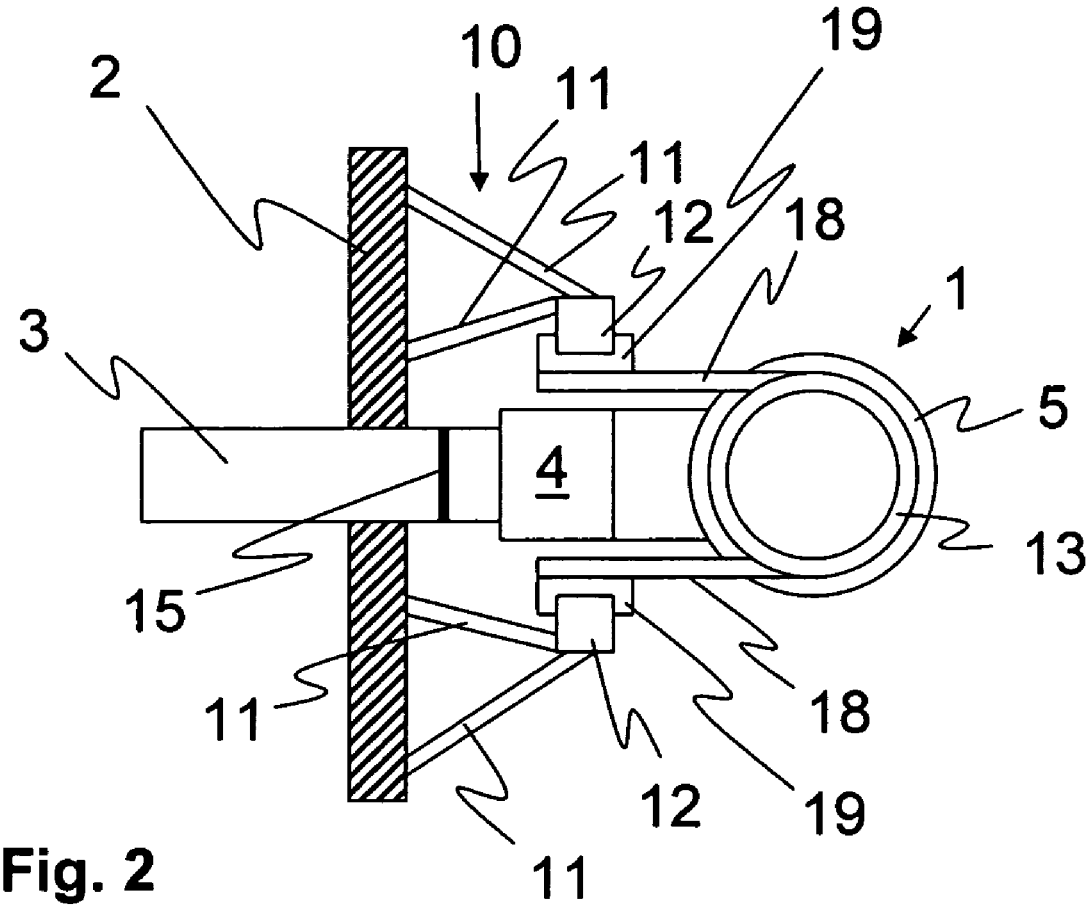
FIG. 2 shows a cross section through the sieve device of FIG. 1.

FIG. 2 shows an embodiment of a fastening device 10. Sieve device 1 is connected to holder 13 by fastening device 10. To this end two arms 18 are arranged on holder 13, on each of which arms a sliding element 19 is located. Sliding element 19 surrounds guide 12 arranged on transmission 11 of fastening device 10. Guides 12 are at an interval from one another that allows loading container 4 and the movable part of connection device 15 to be moved between them out of shaft 2. Transmission 11 is designed to be stable so that a stable fastening of sieve device 1 in shaft 2 is ensured even in the case of torques of sieve device 1 occurring, e.g., during the starting or braking of the worm conveyor, and therewith the loose connection device 15 also remains substantially sealed.

Figure 3:
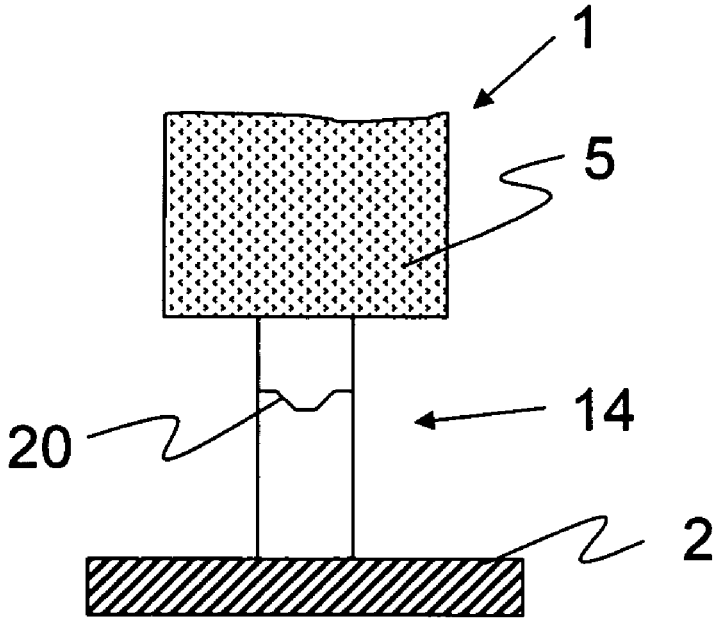
FIG. 3 shows a schematic view of an axial stop of the sieve device.

FIG. 3 shows the axial support of sieve device 1. To this end a stop is provided on sieve body 5 which stop corresponds to dovetail guide 20 of stop 14. Dovetail guide 20 ensures that sieve device 1 is correctly positioned, especially with regard to loose connection device 15 and also that the weight of sieve device 1 can be safely received by stop 14.

Figure 4:
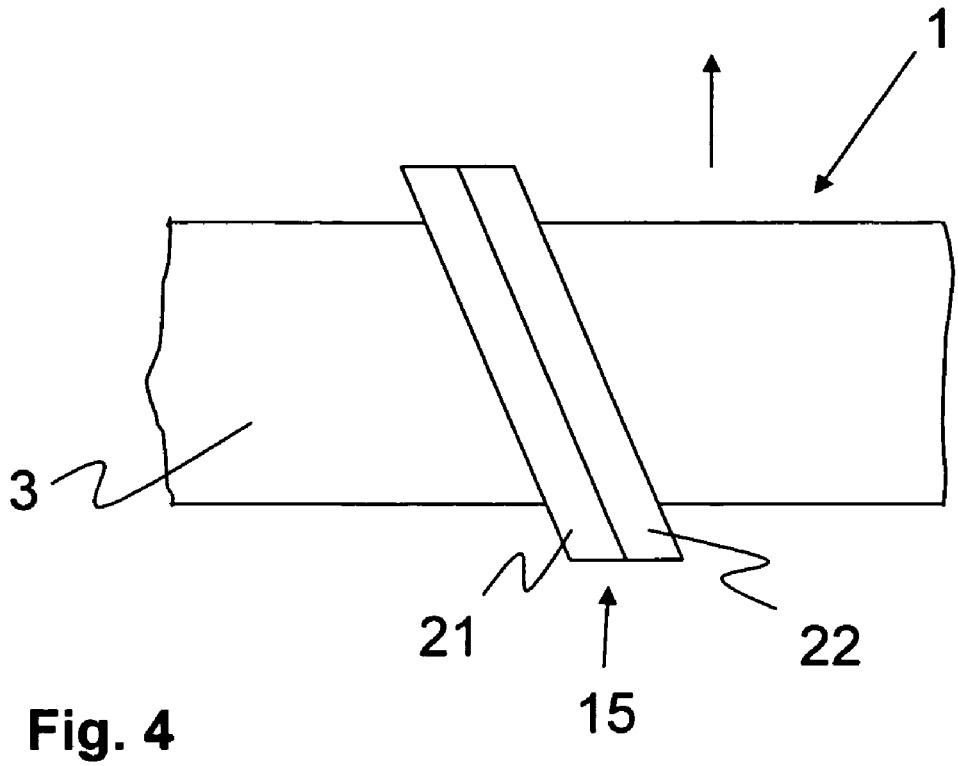
FIG. 4 shows a detail of a loose connection device.

FIG. 4 shows a detail of a variant of an embodiment of loose connection device 15. To this end flange 21 and flange 22 are arranged on an oblique section of feed pipe 3 and on sieve device 1. If sieve device 1 is removed from supply pipe 3 in the direction of the arrow, connection device 15 is opened. During a subsequent mounting of sieve device 1, the two flanges 21, 22 are merely pressed against one another, thus ensuring a loose connection between supply pipe 3 and sieve device 1. This connection is sufficient for the present necessary purposes.

Figure 5:
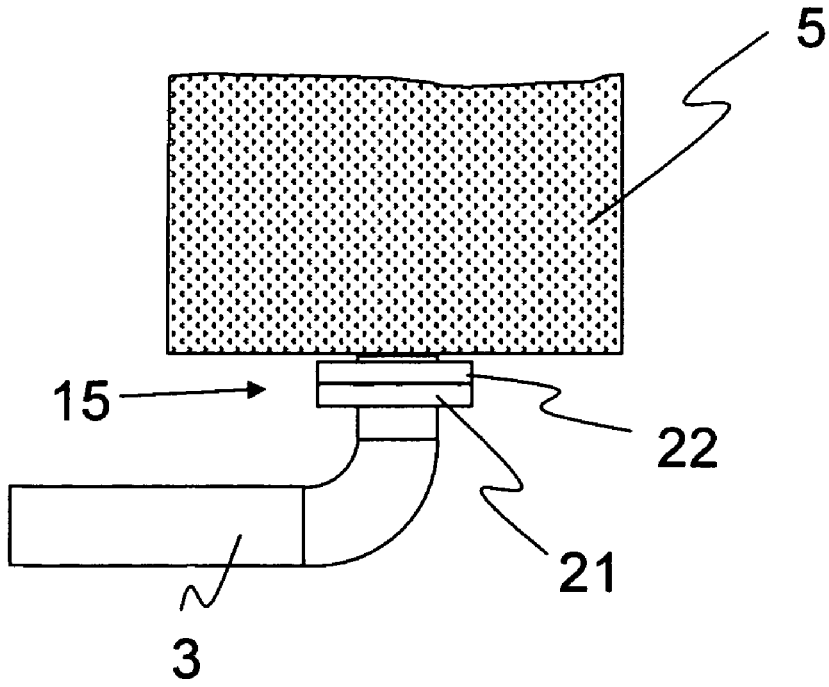
FIG. 5 shows a detail of another embodiment of a loose connection device.

FIG. 5 shows an alternative embodiment of a connection of supply pipe 3 to sieve device 1. Here, the corresponding flanges 21, 22 are arranged below sieve body 5. Sieve body 5 can be raised together with sieve device 1 from supply pipe 3 when sieve device 1 is moved out of shaft 2. When sieve device 1 is put back a substantially tight connection is produced at the position of flanges 21, 22. Alternatively, a pipe piece 3 can empty directly into sieve body 5. This can also create a sufficiently loose connection 15 that can be loosened without screw connections or other connections to be actuated on site.

Of course, the corresponding loose connection device 15 can also be provided between loading container 4 and sieve device 1 in the same manner as described above. It is essential in any case that the worm conveyor to be serviced can be removed from shaft 2 without mounting work having to be carried out in shaft 2.

Accordingly, the invention is not limited to the exemplary embodiments shown. Of course, other guides and positionings of the sieve device in accordance with the text of the claims are also conceivable. For example, the sieve device can be moved by cables out of and into the shaft. The exact guidance can take effect only directly before reaching the intersection between the sieve device and the supply device and does not have to be present during the entire path of the sieve device into the shaft.

The invention claimed is:

1. A sieve apparatus for treating wastewater delivered into a shaft for separating material from the wastewater, comprising:

a supply device configured to deliver the wastewater into the shaft;

a sieve device insertable into and movable vertically within the shaft, said sieve device further comprising a sieve surface disposed so as to receive wastewater from said supply device and remove material therefrom, and a connection device in liquid communication with said sieve surface that engages said supply device at an intersection whereby wastewater is delivered into said sieve surface;

a worm conveyor disposed within the shaft and extending generally vertically from said sieve surface to transport the material separated out of the wastewater by said sieve surface;

a fastening device configured within and fixed to the shaft to support said sieve device in an upright operational position, said fastening device comprising a guide system along which said sieve device moves vertically, said guide system arranged such that at a lowered operational position of said sieve device on said guide system, said connection device mates with said supply device and establishes a flow path for the wastewater into the sieve surface; and wherein said connection device forms a non-locking abutting interface with said supply device such that said sieve device is freely movable vertically away from said supply device without a further mechanical disconnection of said connection device from said supply device.

2. The apparatus as in claim 1, wherein said supply device comprises a pipe that extends into the shaft.

3. The apparatus as in claim 1, wherein said supply device comprises a loading container disposed in the shaft that is supplied with the wastewater.

4. The apparatus as in claim 1, wherein said connection device comprises a flange that abuts against an opposing flange on said supply device to form said non-locking abutting interface.

5. The apparatus as in claim 1, wherein said guide system comprises members along which said sieve device slides axially within the shaft.

6. The apparatus as in claim 1, wherein said fastening device is configured to absorb torsional loads placed on said sieve device so that said connection piece remains mated with said supply device during starting and braking of said worm conveyor.

7. The apparatus as in claim 1, further comprising a closure device in said supply device that is actuated externally of the shaft.

8. The apparatus as in claim 1, further comprising an axial stop at a bottom of the shaft against which sieve device engages in a lowered operation position thereof.

9. The apparatus as in claim 1, wherein said supply device extends generally transversely into the shaft.

10. A sieve apparatus for treating wastewater delivered into a shaft for separating material from the wastewater, comprising:

a supply device configured to deliver the wastewater into the shaft;

a sieve device insertable into and movable vertically within the shaft, said sieve device further comprising a sieve surface disposed so as to receive wastewater from said supply device and remove material therefrom, and a connection device in liquid communication with said sieve surface that engages said supply device at an intersection whereby wastewater is delivered into said sieve surface;

a worm conveyor disposed within the shaft and extending generally vertically from said sieve surface to transport the material separated out of the wastewater by said sieve surface;

a fastening device configured within and fixed to the shaft to support said sieve device in an upright operational position, said fastening device comprising a guide system along which said sieve device moves vertically, said guide system arranged such that at a lowered operational position of said sieve device, said connection device mates with said supply device and establishes a flow path for the wastewater into the sieve surface;

wherein said connection device comprises a flange that abuts against an opposing flange on said supply device to form said non-locking abutting interface; and wherein said flange on said supply device has an upward open oblique orientation, and said flange on said connection device has a downward open opposite oblique orientation.

11. A sieve apparatus for treating wastewater delivered into a shaft for separating material from the wastewater, comprising:

a supply device configured to deliver the wastewater into the shaft;

a sieve device insertable into and movable vertically within the shaft, said sieve device further comprising a sieve surface disposed so as to receive wastewater from said supply device and remove material therefrom, and a connection device in liquid communication with said sieve surface that engages said supply device at an intersection whereby wastewater is delivered into said sieve surface;

a worm conveyor disposed within the shaft and extending generally vertically from said sieve surface to transport the material separated out of the wastewater by said sieve surface;

a fastening device configured within and fixed to the shaft to support said sieve device in an upright operational position, said fastening device comprising a guide system along which said sieve device moves vertically, said guide system arranged such that at a lowered operational position of said sieve device, said connection device mates with said supply device and establishes a flow path for the wastewater into the sieve surface;

wherein said connection device forms a non-locking abutting interface with said supply device such that said sieve device is freely movable vertically away from said supply device without a further mechanical disconnection of said connection device from said supply device; and further comprising a sliding seal between said connection device and said supply device at said non-locking abutting interface.

* * * * *